United States Patent [19]

Poteet et al.

[11] 4,354,845

[45] Oct. 19, 1982

[54] IDENTIFICATION STRUCTURE FOR GAMES AND EDUCATIONAL USE AND FOR OTHER USE

[76] Inventors: Ronald J. Poteet; Anne P. Poteet, both of 4377 Tangent Dr., Dayton, Ohio 45440

[21] Appl. No.: 210,016

[22] Filed: Nov. 24, 1980

[51] Int. Cl.[3] ..... A63F 3/06; A63F 9/18; G09F 19/00

[52] U.S. Cl. ..... 434/410; 434/329; 434/346; 434/363; 273/DIG. 14; 273/240; 273/269

[58] Field of Search ..... 434/410, 425, 408, 413, 434/370, 329, 346; 273/240, DIG. 14, DIG. 26, 269, 270, 378; 40/406

[56] References Cited

U.S. PATENT DOCUMENTS

| | | | |
|---|---|---|---|
| 1,568,548 | 1/1926 | Edelson | 273/240 |
| 3,497,970 | 3/1970 | Padowicz | 434/410 |
| 3,512,273 | 5/1970 | Baker, Jr. et al. | 434/410 X |
| 4,133,536 | 1/1979 | Cole | 273/240 |
| 4,212,468 | 7/1980 | Knott | 273/240 |

FOREIGN PATENT DOCUMENTS

| | | | |
|---|---|---|---|
| 689870 | 6/1964 | Canada | 434/425 |

*Primary Examiner*—Richard C. Pinkham

*Assistant Examiner*—Scott L. Brown

*Attorney, Agent, or Firm*—Jacox & Meckstroth

[57] ABSTRACT

An identification structure and method for temporary or short term identification of a portion of a surface or substrate. The structure and method include the use of viscous material which is displaced by pressure applied thereto and which retains its displaced condition until smoothed out by any suitable means. Preferably, the viscous material is enclosed in a substantially flat bag which has opposed transparent portions. The viscous material is visible but also has a high degree of transparency. Identification of a portion of a surface or substrate is made as the bag is positioned immediately above or adjacent thereto or in engagement with the surface or substrate. All portions of the surface or substrate are normally visible through the bag and through the viscous material. Pressure is applied to the bag immediately above the portion of the surface to be identified. Such pressure displaces the portion of the viscous material which is immediately above the portion of the surface or substrate to be identified, and that portion of the surface or substrate is thus directly visible through the bag. Thus, the identified portion of the surface or substrate is a portion which is more clearly visible through the bag than portions of the surface or substrate which have the viscous material immediately thereabove.

12 Claims, 11 Drawing Figures

IDENTIFICATION STRUCTURE FOR GAMES AND EDUCATIONAL USE AND FOR OTHER USE

BACKGROUND OF THE INVENTION

Several games, such as Bingo, and the like, require the identification or marking of numbers or other indicia which appear on cards or other surfaces. Customarily, during a game such as Bingo, a player picks up a cover piece of wood, cardboard, or plastics material, or the like to cover numbers which are called by the operator of the game. Many people who play Bingo have difficulty in picking up and handling such a cover piece.

In order to eliminate the need for handling cover pieces, several types of cover devices or systems have been devised for use in identification or marking of numbers called in a Bingo game. A device referred to as a dobber has been used. Other marking devices have been employed. However, each of such devices and/or systems have had serious disadvantages and objectionable features. Some marking devices create permanent marks. Other marking devices and systems are difficult to handle or are costly.

BRIEF SUMMARY OF THE INVENTION

It is therefore an object of this invention to provide identification structure for use in a game such as Bingo to identify the numbers which are called for identification and in which it is not necessary for a person to manually pick up a cover piece to identify a number or other indicia.

It is another object of this invention to provide such identification structure and system which may be employed in the educational field for identifying answers to questions or the like.

It is another object of this invention to provide such identification structure and system which may be employed in the identification of portions of maps or other papers and the like.

It is another object of this invention to provide such identification structure and system which is easily and readily portable, and which is reusable.

It is another object of this invention to provide such identification structure and system which is capable of retaining the identification conditions thereof while being carried and/or while being repositioned.

Other objects and advantages of this invention reside in the construction of parts, the combination thereof, the method of production, and the mode of operation, as will become more apparent from the following description.

DETAILED DESCRIPTION OF THE INVENTION

Identification structure of this invention as illustrated in FIGS. 1–5, comprises two substantially transparent sheets, herein shown as sheets 20 which are attached together by any suitable means at marginal edges 20*a* thereof. Thus, the sheets 20 form an enclosed bag 22. Preferably, the sheets 20 are of a clear flexible plastics material, such as polyethylene or the like.

Enclosed between the sheets 20 is a quantity of viscous material 26, such as gelatin or the like, which does not readily flow. A suitable viscous material 26 is, for example, a hair styling gel. Such a gel as a hair styling gel, minus a drying agent, is preferable for use as the viscous material 26. The viscous material 16 is one which has a light degree of visibility. For example, a suitable viscous material 26 is a gelatin which has a slight degree of color therein. A suitable viscous material may be one which is initially clear and colorless and to which light coloring material, such as a light color food coloring material or a die or the like, is added and dispersed therein. The viscous material 26 may be a petroleum jelly, such as Vaseline or the like.

Figure 1:
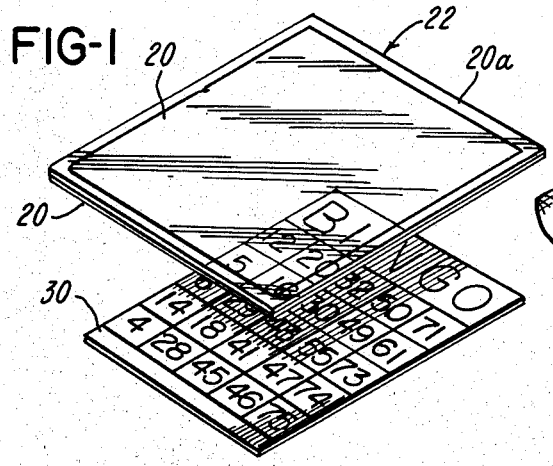
FIG. 1 is a perspective view showing identification structure of this invention positioned above a Bingo card for use therewith to identify portions thereof.
Figure 2:
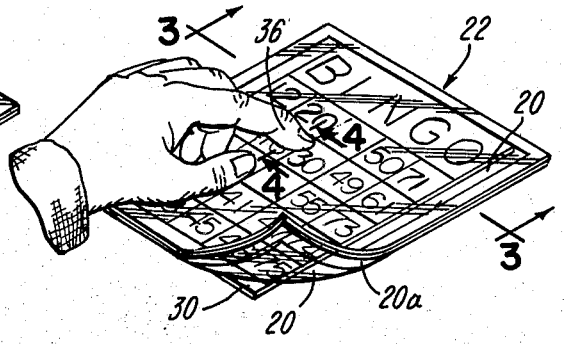
FIG. 2 is a perspective view showing the identification structure and Bingo card of FIG. 1 and illustrating the manner in which the identification structure is used.
Figure 3:
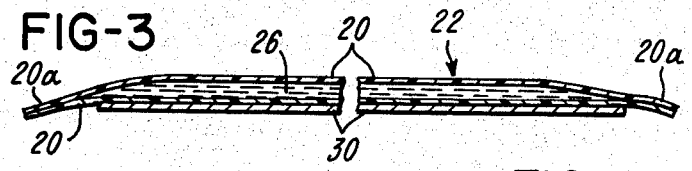
FIG. 3 is an enlarged sectional view taken substantially on line 3—3 of FIG. 2.
Figure 4:
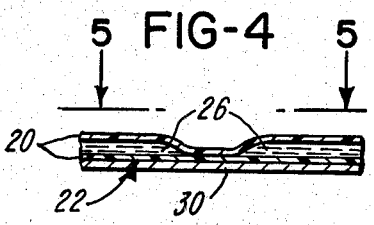
FIG. 4 is an enlarged sectional view taken substantially on line 4—4 of FIG. 2.
Figure 5:
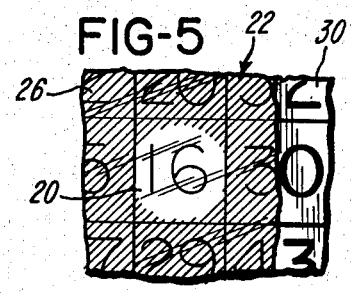
FIG. 5 is a view taken substantially on line 5—5 of FIG. 4.

The bag 22 with the viscous material 26 therein may be laid over a Bingo card 30, in the manner illustrated in FIG. 1. The Bingo card 30 carries rows of numbers thereupon in a conventional manner. Initially all of the numbers carried by the Bingo card 30 are observable through the lightly colored viscous material 26. When it is desired to identify a number, such as the number 16, which is carried by the Bingo card 30, a person's finger 36 is pressed down upon the upper sheet 20 of the bag 22 immediately above the number 16, in the manner illustrated in FIG. 2. Preferably, the finger 36 is pressed downwardly until the portion of the upper sheet 20 which is engaged by the finger 36 is forced against the lower sheet 20. When such pressure is applied to that portion of the bag 22, the viscous material 26 is forced from the portion of the bag 22 immediately above the number 16, as illustrated in FIG. 4. When the viscous material 26 is forced from the portion of the bag 22 immediately above the number 16, there is no significant amount of the viscous material 26 in the portion of the bag 22 immediately above the number 16, and the number 16 is clearly visible through the two sheets 20 of the bag 22, as illustrated in FIG. 5. Thus, the number 16 carried by the Bingo card 30 is identified, without the requirement of a cover piece or marking device or the like.

Likewise, the upper sheet 20 of the bag 22 may be pressed downwardly above any portion of the Bingo card 30 over any number which is to be identified during the game. When each portion of the viscous material 26 is displaced, the viscous material 26 remains displaced until the bag 22 is smoothed-over by a roller or by a person's hand or by any other suitable means.

In some types of uses of the identification structure of this invention it may be desirable to remove the bag 22 from the surface which it covers after portions of the viscous material 26 have been displaced to identify portions of the surface over which the bag 22 is positioned. The bag 22 may be removed from the surface and moved to another location, and the displaced portions of the viscous material 26 remain displaced. The bag 22 may then be positioned upon a second surface and inspected or otherwise inspected to reveal the displaced portions of the bag 22 for determining the portions of the first surface which have been identified by the displaced portions of the viscous material 26. The displaced portions of the viscous material 26 and the pressed portions of the bag 22 remain in such condition until the bag 22 is smoothed-out over its entire surface.

Figure 6:
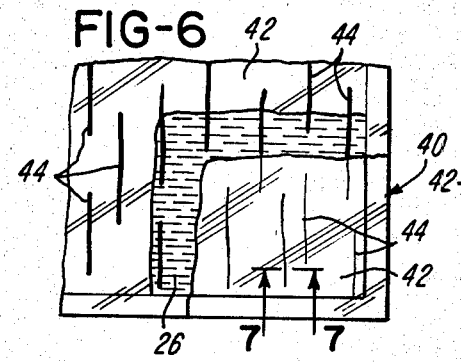
FIG. 6 is a fragmentary view with parts broken away showing a portion of another embodiment of the identification structure of this invention.
Figure 7:
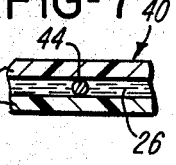
FIG. 7 is an enlarged sectional view taken substantially on line 7—7 of FIG. 6.

FIGS. 6 and 7 illustrate another embodiment of the identification structure of this invention. A bag 40 comprises a pair of clear enclosure sheets 42, similar to the sheets 20 of the bag 22. Within the bag 40 is a viscous material 26. Also, between the clear enclosure sheets 42 of the bag 40 and preferably attached to at least one of the clear enclosure sheets 42 are a plurality of fine threads or cords or strands 44. The cords or threads or strands 44 may, for example, be of nylon material or the like. The cords or threads or strands 44 prevent the viscous material 26 from flowing too readily, and after portions of the bag 40 have been pressed upon, the cords or strands or threads 44 assist in maintaining the viscous material 26 in a pressed out or displaced condition, such as in the condition illustrated in FIG. 5.

Figure 8:
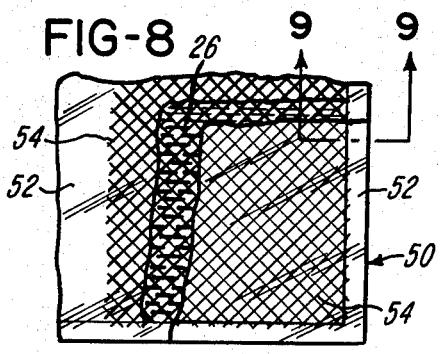
FIG. 8 is a fragmentary view showing a portion of another embodiment of the identification structure of this invention.
Figure 9:
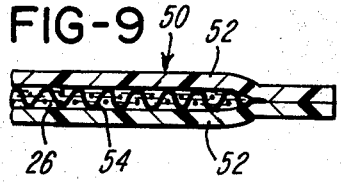
FIG. 9 is an enlarged sectional view taken substantially on line 9—9 of FIG. 8.

FIGS. 8 and 9 illustrate another embodiment in the identification structure of this invention. A bag 50 comprises a pair of clear or transparent enclosure sheets 52 which may be similar to the enclosure sheets 20 or 42 and are sealed together at the periphery thereof. Between the sheets 52 is a viscous material 26. Also between the sheets 52 is a netting 54 of fine strands. The netting 54 may be a netting such as used for bridal veils or the like. The netting 54 may be free within the bag 50 or may be attached to one or both of the sheets 52. The netting 54 prevents the viscous material 26 from flowing too readily and aids in retaining the viscous material 26 in a pressed-out or displaced condition after pressure is applied therto.

Figure 10:
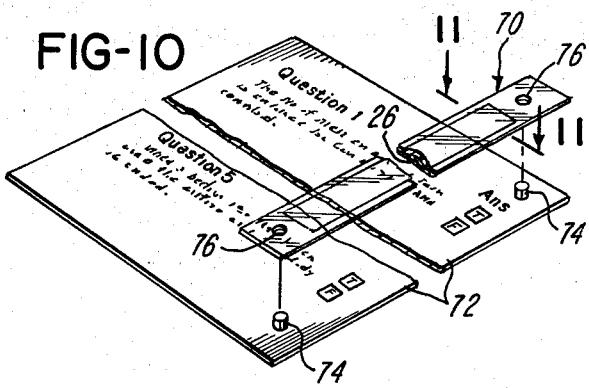
FIG. 10 is a perspective view with parts broken away, showing another embodiment of the identification structure of this invention and illustrating another use of the identification structure of this invention.
Figure 11:
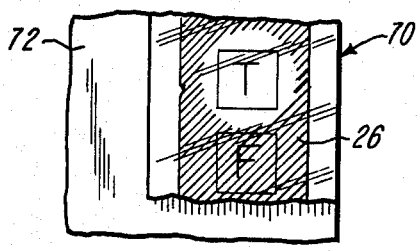
FIG. 11 is an enlarged sectional view taken substantially on line 11—11 of FIG. 10.

FIGS. 10 and 11 illustrate an embodiment of this invention in which a bag 70 is elongate and is adapted to be laid over a question sheet 72 or the like and positioned with respect thereto by pins 74 or the like which extend through sealed apertures 76 in the bag 70. The bag 70 has therewithin the viscous material 26. When a portion of the bag 70 is pressed upon above an answer on the question sheet 72 to identify an answer chosen, the viscous material 26 within the bag 70, remains pressed away or displaced from the region pressed. The bag 70 with the displaced portions, may be removed from the question sheet 72 and examined in any suitable manner, such as by positioning upon another surface to identify the answer selected.

Thus, it is understood that the invention herein is capable of identifying areas without the need to pick up and handle a marking or identifying piece. The portions of the viscous material which are pressed or displaced remain in such displaced condition even when the bag is removed from the original location and moved to another location. The invention herein may thus be employed to identify regions on any desired surface, such as the surface of a game card, a question sheet, or a map or the like.

It is to be understood that identification structure of this invention may be removably or non-removably attached to a surface or substrate for identification of portions thereof.

It is also to be understood that the identification structure of this invention is positionable in juxtaposition with or in engagement with a surface or substrate when the surface or substrate is at any angle, which is not necessarily horizontal.

Although the preferred embodiment of the structure, composition and process of this invention have been described, it will be understood that within the purview of this invention various changes may be made in the parts, form, proportion, composition, and method and the combination thereof, which generally stated consist in a structure, method and composition capable of carrying out the objects set forth, as disclosed and defined in the appended claims.

The invention having thus been described, the following is claimed:

1. Identification structure adapted to be positioned immediately above a surface for identification of portions thereof comprising:

a substantially flat bag having opposed flexible substantially transparent parts, a viscous material within the bag between the transparent parts, the viscous material being visible within the bag but being sufficiently transparent that the surface is visible through the transparent parts of the bag and through the viscous material, the viscosity of the viscous material being such that a portion of the viscous material may be readily displaced within the bag as a result of the application of pressure upon a part of the bag, the viscosity of the viscous material being such that a portion of the viscous material which is displaced remains displaced, displacement of such portion of the viscous material by application of pressure upon a portion of a transparent part of the bag displacing and removing substantially all the viscous material from below the portion of the transparent part of the bag to which pressure is applied, so that a portion of the surface immediately below that portion of the transparent part of the bag is observable directly through the transparent parts of the bag, a portion of the surface thus being identified as that portion of the surface which is more clearly visible through the transparent parts of the bag than portions of the surface above which the viscous material has not been displaced.

2. The identification structure of claim 1 which includes strips of thread within the bag and attached to at least one of the transparent parts of the bag to partially restrict displacement of the viscous material and to maintain portions of the viscous material in displaced condition after displacement thereof.

3. The identification structure of claim 1 which includes netting material within the bag to partially restrain displacement of the viscous material an to maintain portions of the viscous material in displaced condition after displacement thereof.

4. Identification structure to identify indicia on a surface upon which the identification structure is positioned comprising:

a substantially flat transparent bag, viscous material within the transparent bag, the viscous material being sufficiently viscous to remain displaced after being displaced by pressure applied thereto, the viscous material being visible but also substantially transparent so that the surface is visible through the transparent bag and through the viscous material therewithin, pressure being applied to a part of the bag which is immediately above a portion of the surface to be identified, the viscous material thus being displaced from said part of the bag and from said portion of the surface so that said portion of the surface is visible through the transparent bag without significant viscous material immediately above said portion of the surface.

5. The identification structure of claim 4 in which the transparent bag comprises a pair of transparent sheets attached together at the marginal portions thereof.

6. The identification structure of claim 4 in which the fluid material is a gelatin material.

7. The identification structure of claim 4 in which the fluid material is a petroleum gel.

8. The identification structure of claim 4 which includes strands of material within the bag to partially restrain displacement of the viscous material and to assist in retaining displacement thereof.

9. The identification structure of claim 4 which includes netting material within the bag to partially restrain displacement of the viscous material and to assist in retaining displacement thereof.

10. The identification structure of claim 4 in which the fluid material is a hair styling gel.

11. Identification structure to identify indicia on a surface upon which the identification structure is positioned comprising:

a sheet having a substantially transparent portion positioned above the surface, a body of viscous material positioned between the transparent portion of the sheet and the surface, the viscous material being visible but also being sufficiently transparent that the surface is visible through the transparent portion of the sheet, the transparent sheet being adapted to have pressure applied thereto at a portion thereof which is immediately above a portion of the surface to be identified, the viscous material being a material which is displaced by pressure applied thereto through the transparent portion of the sheet and the viscous material being of a character to remain displaced until smoothed out by smoothing pressure applied thereto, a portion of the surface thus being identified as a portion more readily visible through the transparent sheet than portions of the surface above which the viscous material is not displaced.

12. The method of identifying a portion of a surface comprising:

positioning a body of viscous material immediately above the surface, the viscous material being a material in which a portion thereof is readily displaced as pressure is applied thereto and which remains displaced, the viscous material being visible but also substantially transparent so that the surface is visible through the viscous material, containing the viscous material in a substantially flat bag of flexible transparent material, applying pressure to the portion of the viscous material which is immediately above a portion of the surface to be identified so that the portion of the viscous material which is immediately above said portion of the surface is displaced and remains displaced until smoothing pressure is applied generally to the body of viscous material.

* * * * *

UNITED STATES PATENT AND TRADEMARK OFFICE

CERTIFICATE OF CORRECTION

PATENT NO. : 4,354,845

DATED : October 19, 1982

INVENTOR(S) : Ronald J. Poteet and Anne P. Poteet

It is certified that error appears in the above-identified patent and that said Letters Patent are hereby corrected as shown below:

Column 2, line 32, change "16" to ---26---.

Column 3, line 14, change "may then" to ---then may---.

Signed and Sealed this

*Eighteenth* Day of *January 1983*

[SEAL]

*Attest:*

GERALD J. MOSSINGHOFF

*Attesting Officer*

*Commissioner of Patents and Trademarks*